United States Patent [19]

Wieczerniak

[11] 4,035,249

[45] July 12, 1977

[54] ELECTRODEPOSITION OF TIN-CONTAINING ALLOYS AND BATH THEREFOR

[75] Inventor: Walter J. Wieczerniak, Sterling Heights, Mich.

[73] Assignee: Oxy Metal Industries Corporation, Warren, Mich.

[21] Appl. No.: 661,480

[22] Filed: Mar. 1, 1976

Related U.S. Application Data

[63] Continuation-in-part of Ser. No. 585,548, June 10, 1975, abandoned.

[51] Int. Cl.[2] ..... C25D 3/56; C25D 3/60

[52] U.S. Cl. ..... 204/43 S; 204/43 T

[58] Field of Search ..... 204/43 Z, 43 S, 43 T, 204/123

[56] References Cited

U.S. PATENT DOCUMENTS 3,881,919 5/1975 Hyner et al. ..... 204/43 S X

*Primary Examiner*—G. L. Kaplan

*Attorney, Agent, or Firm*—B. F. Claeboe

[57] ABSTRACT

An electrodeposited bright coating simulating in appearance that of chromium is formed on a metal-bearing substrate with substantial production economies by contacting the metallic layer on the susbstrate with an aqueous solution including therein a source of cobalt, nickel or iron ions; a source of tin ions; and a complexing agent selected from the group consisting of gluconate, glucoheptonate, or mixtures thereof. If desired, the aqueous solution may include a source of zinc ions. During the process the thickness of the chromium-like appearance coating is controlled so that it does not substantially exceed five micrometers.

9 Claims, No Drawings

ELECTRODEPOSITION OF TIN-CONTAINING ALLOYS AND BATH THEREFOR

CROSS REFERENCE TO RELATED CASES

This case is a continuation-in-part of U.S. Ser. No. 585,548, filed June 10, 1975 now abandoned.

BACKGROUND OF THE INVENTION

It is known in the art to which this invention pertains to provide upon a suitable substrate nickel and chromium coatings. Particularly with respect to relatively small metal parts, this involves what is termed in the art as "bulk plating", and while it is relatively simple to barrel plate relatively small parts such as screws and the like with bright nickel in various types of barrel apparatus, to then chromium plate these same parts which have been bulk nickel plated is relatively difficult, and it is normally necessary that the parts be transferred from the barrel in which they have been nickel plated. It is required that the parts to be chromium plated be transferred to special barrels, which is an expensive operation, and these same barrels have limited capacities, accordingly, chromium plating has been accomplished in trays. This, however, requires substantial labor and ultimately results in a plating cycle which is quite cost-consuming.

SUMMARY OF THE INVENTION

It has now been discovered by applicant that the aforementioned disadvantages of the prior art procedures directed to nickel-chromium electrodeposition may be effectively overcome with substantial cost savings if subsequent to plating upon a metal-bearing substrate there is electrodeposited a layer formed from an aqueous solution which includes therein a source of cobalt, nickel or iron ions; a source of tin ions; and a complexing agent which is selected from the group consisting of gluconate, glucoheptonate, or mixtures thereof. The aqueous solution may, if desired also include a source of zinc ions to further improve the color and luster of the electrodeposit. The substrate may be brass, steel, a zinc die casting or may also be a polymeric substance which has been electroless nickel plated. The nickel-bearing coating may be a combination of nickel and iron, bright nickel, or nickel cobalt depending upon the ultimate application for the workpiece. Various solution ingredients for the chromium plate of this invention will be described herein, and preferred plating conditions will be described. It is an important aspect of this invention that the thickness of the chromium-like coating be controlled so that it does not substantially exceed five micrometers, and by so proceeding there is avoided an unevenness in the appearance of the substituent chromium-like coating, a fine grain coating is achieved, and there is good coherency. The total plating operation is quite clearly simplified and at the same time substantial production economies are accomplished.

DESCRIPTION OF THE PREFERRED EMBODIMENT

The substrate upon which the electroplating is to be accomplished is generally a metallic surface exemplified by brass, steel, a zinc casting, or may also be a polymeric substance such as acrylo-nitrile-butadiene-styrene, polyethylene, polypropylene, polyvinyl chloride and phenol-formaldehyde polymers which have been electroless plated prior to reception of the chromium-simulating electrodeposited layer which forms the substance of this invention.

To be more specific, and in accordance with the novel concepts of this invention, the metal-bearing substrate is contacted with a metallic layer from an aqueous solution which includes therein in the braod sense ½ to 5 grams per liter of a source of cobalt, nickel or iron ions, and more preferably, 1-½ to 3 grams per liter of these same ions. As to the tin ions, this is preferably in the stannous phase and in a broad range is present between ½to 5 grams per liter, and more preferably 1 to 5 grams per liter. Within the purview of this invenion there is present a complexing agent which is selected from the group consisting of hydroxy carboxylic acids, and more particularly, gluconate, glucoheptonate, or mixtures thereof, which in a broad sense are present from 5 to 50 grams per liter, and more specifically, 10 to 30 grams per liter. However, in order to further improve the color and luster of the electrodeposit there may be substituted in part for the source of tin ion zinc ions in the amount of 1.0 to 4.0 grams per liter, and more preferably 2.0 to 3.0 grams per liter as the source of zinc ions. Broadly speaking, the pH during formulation is controlled between about 3 to 10, and more preferably from about 4 to 10. In this manner, the chromium-like appearance of the coating is controlled so that it does not substantially exceed 5 micrometers. It is important to note at this point that the use of gluconate or glucoheptonate as the complexing agent is superior to the use, for example, of citrate or tartrate as the complexing agent in that the stability of the solution is distinctly better with gluconate or glucoheptonate. With tartrate, for instance, as the solution is allowed to stand for a relatively lengthy period, tin salts will precipitate from the solution. In addition, the appearance of the electrodeposit which is deposited from a solution containing gluconate or glucoheptonate is distinctly superior in uniformity and color as compared to the use of other complexing agents.

The invention will be more fully understood when reference is made to the following examples which set forth the process details and the compositions employed therein which provide the novel results to which reference has previously been made.

EXAMPLE I

A solution for the production of a chrome-like finish on nickel was prepared by dissolving 15 g/l of sodium gluconate, 7 g/l of cobalt sulfate heptahydrate )$CoSO_4 \cdot 7H_2O$), 3 g/l of stannous sulfate and 20 g/l of sodium sulfate. The pH of the solution was then adjusted to about 8 with sodium hydroxide. A newly nickel plated workpiece was then immersed in the solution and plated for approximately one minute at 120° F. at 10 ASF. The deposit was bright and had the appearance of chromium.

EXAMPLE II

To further illustrate the novel results achieved by this invention, a solution was also prepared for the purpose of producing a chrome-like finish on nickel, and this was prepared by dissolving 15 g/l of sodium gluconate, 7 g/l of ferrous sulfate, 3 g/l of stannous sulfate and 20 g/l of sodium sulfate in water. The pH of the solution was adjusted to about 8 with sodium hydroxide, a newly nickel plated workpiece was immersed in the solution, and plated for approximately one minute at 120° F. at 10 ASF. It was found that the deposit was bright and clearly had the appearance of chromium.

EXAMPLE III

A solution for producing a chrome-like finish on nickel was prepared by dissolving 30 g/l of $C_5H_{11}O_5$-COONa in water. To this was added 7 g/l of $CoSO_4 \cdot 7H_2O$, 6 g/l $ZnSO_4 \cdot H_2O$, 2 g/l $SnSO_4$ and 20 g/l $Na_2SO_4$. The pH of the solution was adjusted to 8 with NaOH. A freshly nickel plated workpiece was immersed into the solution and connected to the cathode pole of a DC power source. Stainless steel strips were then connected to the anode pole of the power source to complete the circuit. The workpiece was then plated for 1 minute at 75° F. at 5 ASF. The deposit was bright and had the appearance of chromium.

EXAMPLE IV

Another solution for producing a chrome-like finish on nickel was prepared by dissolving 25 g/l $C_5H_{11}O_5$-COONa inwater. To this was added 7 g/l of $CoSO_4 \cdot 7H_2O$, 2 g/l $SnSO_4$, 3 g/l $ZnSO_4 \cdot H_2O$ and 20 g/l $Na_2SO_4$. The pH of the solution was adjusted to 8 with NaOH. A freshly nickel plated workpiece was immersed in the solution and plated for 1 minute at 75° F. at 10 ASF. The deposit was bright and had the appearance of chromium.

EXAMPLE V

A solution for producing a chrome-like finish on nickel was also prepared by dissolving in water 7 g/l of $CoSO_4 \cdot 7H_2O$, 4 g/l $SnSO_4$, 20 g/l $Na_2SO_4$ and 20 g/l of sodium alpha glucoheptonate. The pH of the solution was adjusted to 8 with NaOH. A freshly nickel plated workpiece was then immersed in the solution and plated at 10 ASF for 1 minute. The deposit was bright and looked like chromium.

EXAMPLE VI

Still another solution was made up by dissolving in water 10 g/l of $CoSO_4 \cdot 7H_2O$, 4 g/l $SnSO_4$, 20 g/l $Na_2SO_4$ and 20 g/l of sodium beta glucoheptonate. The pH was adjusted to 8 with NaOH. A freshly nickel plated workpiece was then immersed in the solution and plated at 10 ASF for 1 minute. The deposit was bright and looked like chromium.

EXAMPLE VII

A solution for producing a chrome-like finish on nickel was made by dissolving 7 g/l cobalt sulfate heptahydrate, 10 g/l ferrous sulfate heptahydrate, 4 g/l stannous sulfate, 20 g/l sodium sulfate, and 20 g/l of sodium $\beta$ glucoheptonate in water. The pH of the solution was adjusted to 8 with sodium hydroxide. A freshly nickel plated workpiece was immersed into the solution and plated for 1 minute at 120° F at 10 ASF. The deposit was bright and had the appearance of chromium.

Both sodium alpha and beta glucoheptonate produce stable solutions which can tolerate more tin and greater pH fluctuations without harming the deposit. Of the two materials sodium beta glucoheptonate is at present preferred since it produced the best results.

It can be seen from the foregoing description that many of the disadvantages of prior art techniques have been obviated, and it has been demonstrated that when the teachings set forth herein are followed, the workpieces can withstand what are termed in the art as mild or moderate exposure, that is, Class I and II as defined by ASTM B-456 standards. The necessity of transferring parts from one barrel to another or to racks in order to successively plate chromium upon nickel is no longer necessary, and of course, substantial cost advantages are thereby achieved. Additonally, the substitute coatings for chromium herein described can be readily formulated of low-cost chemical compounds.

Various modifications in the processes and formulations of this invention have been noted hereinabove, and these and other changes can of course be practiced without departing from the spirit of the invention or the scope of the subjoined claims.

What is claimed is:

1. A method of electroplating a bright firmly adherent coating upon a substrate having a metallic layer thereon, which comprises contacting said metallic layer with an aqueous solution including therein 1/2 to 5 grams per liter of cobalt, nickel or iron ions; about 1/2 to 5 grams per liter of tin ions; and 5 to 50 grams per liter of a complexing agent selected from the group consisting of gluconate, glucoheptonate or mixtures thereof, maintaining the pH of the solution within the range of 4 to 10, electroplating said coating from said solution and controlling the thickness of said coating so that it does not substantially exceed 5 micrometers.

2. A method of electroplating as defined in claim 1, in which the complexing agent is present in an amount of between 10 to 30 grams per liter.

3. A method of electroplating as defined in claim 1, in which the temperature is controlled within the range of about 75 to 140 degrees F.

4. A method of electroplating as defined in claim 1, in which the aqueous solution also includes about 1.0 to 4.0 grams per liter of zinc ions.

5. A method of electroplating as defined in claim 4, wherein the zinc ions are present in an amount of from about 2.0 to 3.0 grams per liter.

6. An aqueous bath composition for electroplating a bright firmly adherent coating upon a substrate having a metallic layer thereon, which composition includes therein ½ to 5 grams per liter of cobalt, nickel and iron ions; about 1/2 to 5 grams per liter of tin ions; and 5 to 50 grams per liter of a complexing agent selected from the group consisting of gluconate, glucoheptonate or mixtures thereof, said composition having a pH within the range of 4 to 10.

7. An aqueous bath composition as defined in claim 6, in which the complexing agent is present in an amount of from 10 to 30 grams per liter.

8. An aqueous bath composition as defined in claim 6, wherein there is about also included about 1.0 to 4.0 grams per liter of zinc ions.

9. An aqueous bath composition as defined in claim 8, wherein the zinc ions are present in an amount of from about 2.0 to 3.0 grams per liter.

* * * * *